US006126339A

United States Patent [19]

Kobayashi

[11] Patent Number: 6,126,339

[45] Date of Patent: Oct. 3, 2000

[54] AUTOMATIC PROCESSOR FOR SILVER HALIDE PHOTOSENSITIVE PHOTOGRAPHIC MATERIAL

[75] Inventor: Hiroaki Kobayashi, Hino, Japan

[73] Assignee: Konica Corporation, Tokyo, Japan

[21] Appl. No.: 09/385,618

[22] Filed: Aug. 30, 1999

[30] Foreign Application Priority Data

Sep. 4, 1998 [JP] Japan ..... 10-251447
Sep. 7, 1998 [JP] Japan ..... 10-253113

[51] Int. Cl.[7] ..... G03D 3/02

[52] U.S. Cl. ..... 396/626; 396/627; 347/68; 239/102.2

[58] Field of Search ..... 396/627, 626; 347/12, 27, 68, 40, 188; 118/52, 313; 239/708, 87, 96, 102.2

[56] References Cited

U.S. PATENT DOCUMENTS 4,736,221 4/1988 Shidara ..... 396/620
5,832,328 11/1998 Ueda ..... 396/627

FOREIGN PATENT DOCUMENTS 0 329 354 A2 8/1989 European Pat. Off. .
0 665 449 A1 8/1995 European Pat. Off. .
195 12 715 A1 10/1995 Germany .
WO 98/19216 5/1998 WIPO .

*Primary Examiner*—D. Rutledge
*Attorney, Agent, or Firm*—Frishauf, Holtz, Goodman, Langer & Chick, P.C.

[57] ABSTRACT

In an apparatus for automatically processing a silver halide photographic light sensitive material by plural processes, provided with a conveyor for relatively conveying the material to the plural processes; and a processing solution supplying device for supplying a processing solution onto the material in at least one of the plural processes, the processing solution supplying device having plural jetting channels, each jetting channel comprising a jetting chamber in which the processing solution is accommodated, a jetting head provided with plural orifices each communicating with the jetting chamber, and a converting element to change the volume of the jetting chamber so that the processing solution is jetted through the plural orifices from the jetting chamber to an outside; each orifice has a length L and a diameter R and a ratio (L/R) is made within a range of 5 to 200.

15 Claims, 10 Drawing Sheets

FIG. 8
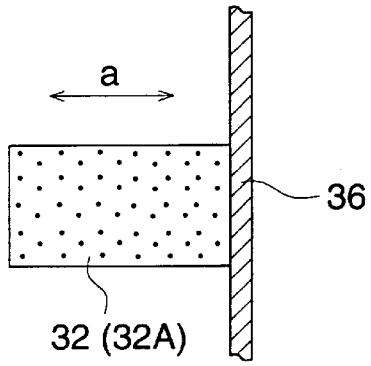
FIG. 9 (A)
FIG. 9 (B)
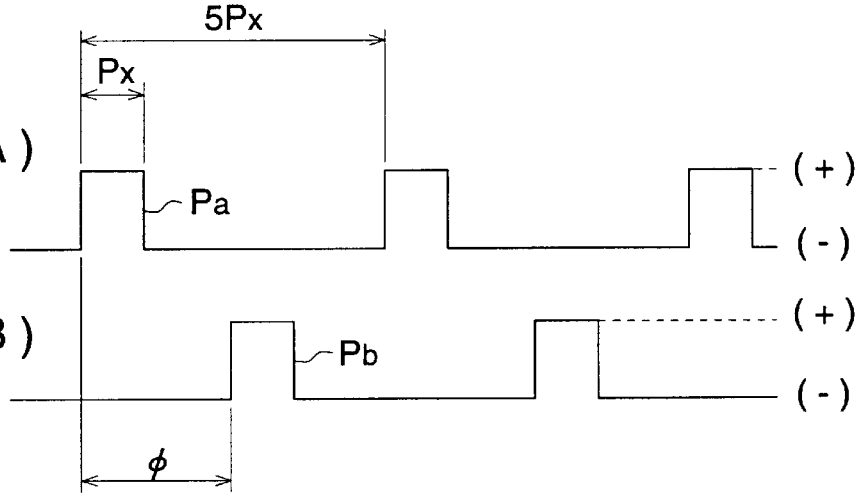

FIG. 13 ( A )
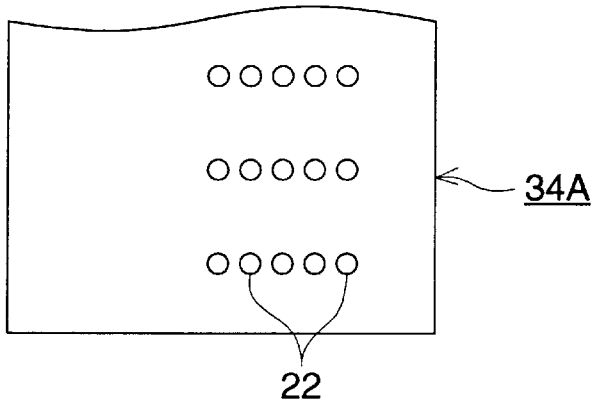
FIG. 13 ( B )
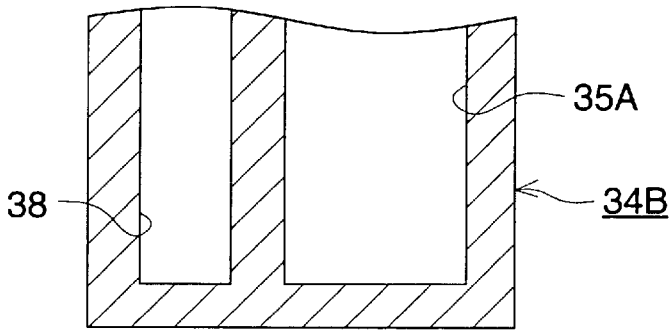
FIG. 13 ( C )
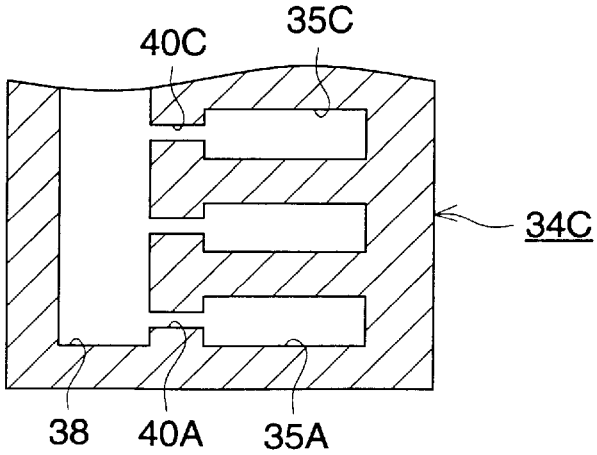

AUTOMATIC PROCESSOR FOR SILVER HALIDE PHOTOSENSITIVE PHOTOGRAPHIC MATERIAL

BACKGROUND OF THE INVENTION

The present invention relates to an automatic processor for a silver halide photosensitive photographic material, and more specifically to an automatic processor for a silver halide photosensitive photographic material which is excellent in high speed processing capability and stability of continual ejection, tends not to result in ejection problems due to clogging, liquid dripping, and the like, and further, improves processability of photosensitive materials such as high rates of processing, uniform dye forming properties, and the like.

In recent years, due to a marked increase in the number of minilabs, the processing amount of photosensitive materials per minilab apparatus has decreased and the solution replacement ratio of photographic processing solution in photographic material processing tanks has decreased. Due to this, processing solutions tend to deteriorate, resulting in instability of processability. Furthermore, for simple-type automatic processors which are installed in minilabs, requirements such as minimal maintenance such as no cleaning of devices and materials as well as curtailment of daily devices and material management have been increased.

In order to meet such requirements, "Japanese Patent Publication Open to Public Inspection No. 6-324455", and the like disclose techniques in which a processing solution which processes silver halide photosensitive photographic materials is placed in a tightly sealed vessel (for example, a processing means placed in a tightly sealed vessel such as an ink jet head), and the processing solution is supplied to the emulsion surface of the photosensitive material through air.

The head of the ink jet system disclosed in the above-mentioned patent publication is required to form highly detailed images. Accordingly, it is constituted so as to spray very fine droplets. Due to that, the supplied amount of a processing solution is fairly small. Thus, if this technique is employed as a processing solution supplying means without any modification, the amount of the processing solution supplied to the emulsion surface of a photosensitive material tends to be insufficient. Particularly, the amount of the color developing agents necessary for carrying out processing becomes absolutely insufficient to increase the reaction time during said processing.

Furthermore, for example, "U.S. Pat. No. 4,901,093" discloses a technique which enables high speed processing by increasing the number of ink jet ejecting nozzles (that is, orifices). However, it has been found that when this technique is merely applied to a processing apparatus which processes silver halide photosensitive photographic materials, the supplied solution amount is still not sufficient.

Further, with this technique, it has been found that in order to maintain more stable ejection of the processing solution, naturally, required is maintenance such as minimization of clogging by cleaning the head section employed as a processing solution supplying means, and the orifices themselves tend to clog.

Further, "Japanese Patent Publication Open to Public Inspection No. 6-324455" describes a technique which mainly processes photosensitive materials for a redox amplification process. It has also found that the silver amount applied to the photosensitive material for the redox amplification process is far less than that of common photosensitive materials, and when the technique is specifically applied to the processing of silver halide photosensitive materials to which the present invention is applied, sufficient effects cannot be obtained and the commercial application is not viable.

Further, a technique described in Japanese Patent Publication Open to Public Inspection No. 9-211832 is one which is developed based on an ink jet system in thermal development. Therefore, this technique has not solved problems with processing particular to silver halide photosensitive photographic materials, to which the present invention is applied, that is, problems with ejection stability during continual ejection of a processing solution, and the like.

As described above, in recent years, the number of minilabs are rapidly increasing, along with demand for more rapid processing. In such situations, demanded is the introduction of an automatic processor which exhibits ease of management of the apparatus and associated materials, and further, is capable of high speed processing.

However, because the above-mentioned ink jet head is primarily constituted to spray very minute liquid droplets, it cannot supply a sufficient amount of the processing solution necessary for adequate reaction. In addition to this, when driving operation is carried out in such a manner that the processing solution is simultaneously ejected from a plurality of orifices over a long period of time and the like, problems occur in which it is difficult to stably supply the necessary amount of the processing solution. Due to this, technical problems which will inevitably be solved are a large increase in the ejection amount of the processing solution, as well as the achievement of stable ejection.

In order to solve these problems, it is enumerated that for example, the driving frequency of a conversion element is subjected to high frequency, or the driving voltage is subjected to high voltage. However, by so doing, the supplied amount of the processing solution is secured, but to the contrary, the formation of the meniscus of the orifice section becomes unstable, which degrades the ejection stability.

In order to prevent this degradation, the number of ejection channels may be increased. However, that results in problems of higher cost, and the difficulty to increase the integration degree of orifices.

The increase in the number of orifices provided in an ejection channel is effective in terms of high possibility to supply a sufficient amount of processing solution. However, it has been found that when an aqueous solution such as a processing solution for silver halide photosensitive photographic materials is ejected, a sufficient ejection amount is not still obtained, and further, the required ejection stability is also not realized.

In addition, differing from an ordinary ink jet printer, it is necessary to continue the ejection of a processing solution from all orifices (nozzles) over a long period of time. Accordingly, it has been found that the conventional orifice constitution tends to result in ejection problems.

As is well known, processing solutions, for silver halide photosensitive photographic materials, are different from inks for ink jet printing sheets of paper, and the main component is water without comprising an organic solvent at all. Due to that, as the contact area with air increases, drying tends to occur due to evaporation. Furthermore, because the concentration of inorganic salts in the photographic processing solution is higher than that of ordinary inks, deposits of inorganic salts tend to occur due to localized drying. Accordingly, serious problems occur in which the clogging of the orifice is caused.

Furthermore, it has newly been found that air bubbles tend to be mixed into the processing solution, because the processing rate during continual processing, employing the processing solution supplying means, is higher than ink jet. The formation of air bubbles may result in pressure loss in the ejection chamber and is likely to result in ejection problems. It has also been found that once the air bubbles are mixed in the ejection chamber, it is very difficult to remove those bubbles from the ejection chamber.

SUMMARY OF THE INVENTION

In view of the foregoing, it is a first object of the present invention to provide an automatic processor for silver halide photosensitive photographic materials, which in the case of ejecting a processing solution for the silver halide photosensitive photographic materials, makes it possible to stably obtain a large ejection amount and to sustain rapid processing.

It is a second object to provide an automatic processor for silver halide photosensitive photographic materials, which neither forms spot blotches on photosensitive materials nor insufficient color development at the ends. It is a third object to provide an automatic processor for silver halide photosensitive photographic materials, in which when all orifices are employed for ejection, the ejection direction is not changed, and further, the main body (a plate) of the orifices is not stained, and the ease of maintenance is achieved.

It is a fourth object to provide an automatic processor for silver halide photosensitive photographic materials, which minimizes the formation of clogging of orifices when employed over a long period. It is a fifth object to provide an automatic processor for silver halide photosensitive photographic materials, in which solution waste is reduced so as to minimize adverse effects to the environment.

(1) In order to solve the above-mentioned problems, an automatic processor for silver halide photosensitive photographic materials according to the present invention is constituted in such a manner that, in the automatic processor for silver halide photosensitive photographic materials, which comprises a plurality of processing procedures, at least one of said processing procedures comprises a processing solution supplying means for silver halide photosensitive photographic materials, which is composed of an ejection chamber which places a processing solution for silver halide photosensitive photographic materials, at least two orifices which are connected to said chamber, and at least two-lined ejection channels, each of which is composed of a conversion element which alters the volume of said ejection chamber, and that the ratio (L/R) of the length L of the above-mentioned orifice to the ejection side diameter R of the above-mentioned orifice is set in the range of 5 to 200.

(2) In the above-mentioned processing solution supplying means, the conversion element which alters the volume of the above-mentioned ejection chamber is a piezoelectric element.

(3) In the above-mentioned processing solution supplying means, phase is provided with expansion and contraction of the conversion element which alters the volume of an adjacent ejection chamber.

(4) In the above-mentioned processing solution supplying means, a phase difference in expansion and contraction of the conversion element, which alters the volume of the adjacent ejection chamber, is at least 10 degrees.

(5) In the above-mentioned processing solution supplying means, the ratio (W/R) of the arrangement pitch W of orifices provided for each ejection chamber composed to the ejection side diameter R of the above-mentioned orifice is set in the range of 2 to 25.

(6) In the above-mentioned processing solution supplying means, the supplied amount of the above-mentioned processing solution is set in the range of 0.01 to 2.5 ml per second.

(7) A heating means is provided which heats the above-mentioned silver halide photosensitive photographic materials to at least 35° C.

(8) A controlling means is provided which controls the amount of supplied processing solution in the above-mentioned supply means in the range of 5 to 100 ml per $m^2$ of the above-mentioned photosensitive material.

(9) The solute concentration of the above-mentioned processing solution is at least 0.2 percent by weight.

(10) Further, in order to solve the above-mentioned problems, an automatic processor for silver halide photosensitive photographic materials according to the present invention is constituted in such a manner that, in the automatic processor for silver halide photosensitive photographic materials, which comprises a plurality of processing procedures, at least one of said processing procedures comprises a processing solution supplying means for silver halide photosensitive photographic materials, which is composed of an ejection chamber which places a processing solution for silver halide photosensitive photographic materials, at least two orifices which are connected to said chamber, and at least two-lined ejection channels, each of which is composed of a conversion element which alters the volume of said ejection chamber, and that the ratio (L/R) of the length L of the above-mentioned orifice to the ejection side diameter R of the above-mentioned orifice is set in the range of 5 to 200.

(11) The viscossity of the processing solution fed from the processing solution supplying means is in the range of 1.2 to 10 cp.

BRIEF DESCRIPTION OF THE DRAWINGS

FIG. 8 is a view showing the direction of expansion and contraction of a piezoelectric element.

FIGS. 9(A) and )(B) are views to explain driving pulses.

FIGS. 13(A) to 13(C) are cross sectional views showing a orifice plate 34A, an intermediate plate 34B and an introducing small conduit forming plate 34C respectively.

DETAILED DESCRIPTION OF THE PREFERRED EMBODIMENT

Figure 1:
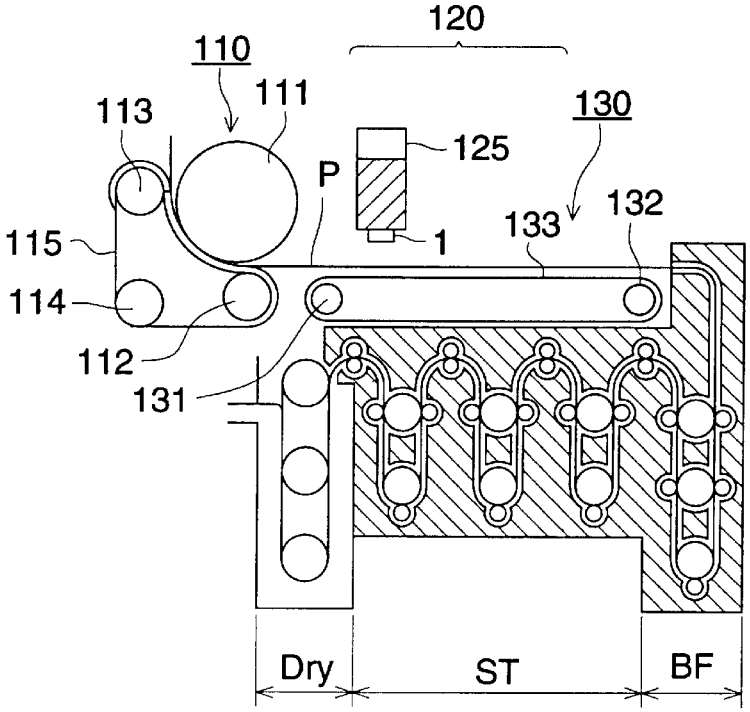
FIG. 1 is a view of the main processing procedure showing one embodiment of the automatic processor for silver halide photosensitive photographic materials according to the present invention.

Subsequently, the embodiments of the automatic processor for silver halide photosensitive photographic materials according to the present invention will be detailed with reference to attached drawings.

The automatic processor for silver halide photosensitive materials according to the present invention comprises at least a means for supplying a processing solution, which ejects the predetermined processing solution for a silver halide photosensitive photographic material and applies said processing solution to the surface of said photosensitive material. Other than this, said automatic processor is composed of a heating means, a bleach-fixing means, a stabilizing means, a drying means, and the like for photosensitive materials. The structure of each means will be described below.

(Processing Solution Supplying Means)

In the present invention, supply of a processing solution is carried out employing an ejection channel. The ejection channel is filled with at least the processing solution to be ejected, and is composed of an ejection chamber which can be pressurized, a conversion element which instantaneously alters the volume of said ejection chamber while converting electrical signals, orifices (nozzles) through which the processing solution in the pressurized ejection chamber is ejected.

The size of the ejection chamber is preferably minute in size, such as {about lateral longitudinal 0.1 mm×(0.1 to 3.0 mm four sides)×5 mm}. The ejection chamber is preferably prepared by laminating thin plates of grooved stainless steel materials (SUS), metal such as titanium, further plastics, etc. together.

Each ejection chamber is provided with at least two orifices. With the intent of increasing the ejection amount, the number of orifices is preferably increased. On the other hand, with the intent of the ejection stability, the number of orifices per chamber is preferably between 2 and 64, and is more preferably between 3 and 32. The number is determined depending on the supplied amount of the processing solution required for the photosensitive material, production yield of the orifice main body (a plate), and the like. Chambers having orifices between about 3 and about 32 is more easily manufactured.

From the viewpoint of the supplied amount of the processing solution as well as the stability of the ejected amount, the means for supplying the processing solution is provided with at least two ejection channels. The number of channels is more preferably between 2 and 100.

In the present invention, in order to carry out stable ejection of the processing solution for silver halide photosensitive photographic materials, the ratio (L/R) of the length L of the orifice to the ejection end diameter R of the orifice is preferably in the range of 10 to 100, and is most preferably in the range of 20 to 50. The number of orifices is selected between 20 and 50 so that more stable ejection of the processing solution can be carried out, and a sufficient amount of the processing solution can be supplied.

Herein, the length L of the orifice is preferably between 0.1 and 10 mm, and is more preferably between 0.5 and 5 mm. With consideration of the mechanical strength and the like, the latter value is optimal. The ejection end diameter R of the orifice is preferably between 0.03 and 0.2 mm. Such range is selected so that clogging of the processing solution, solution dripping, mixing of air bubbles into the ejection chamber, and the like are less likely to occur.

Introducing small tube for the processing solution is provided to the processing solution supplying means. The portion which is constructed on the side surface of the jetting chamber and is a passage for the processing solution when the processing solution is introduced from the processing solution tank (buffer tank) to the jetting chamber, is named as the introducing small tube. With this introducing small tube, the pressure applied to the jetting chamber is further applied to the orifice without causing loss, thereby making the liquid jetting possible.

In the present invention, the ratio $K/\sqrt{S}$ of the length K of the introducing small tube to the square root of the cross sectional area S of the introducing small tube is set 0.03 to 30. By setting the ratio $K/\sqrt{S}$ within this range, the dispersion in an amount (jetting amount) of the solution jetted from the orifice can be minimized, thereby preventing irreguralities in coloring density on the light sensitive material.

Further, by setting the ratio $K/\sqrt{S}$ within this range, it become possible to jet the solution with high duty ratio. It may be preferable to set the ratio $K/\sqrt{S}$ within the range of 0.5 to 20. Especially, in order of minimize the dispersion in jetting amount, it may be more preferable to set the ratio $K/\sqrt{S}$ within the range of 1 to 10. It may be preferable that the shape of the cross sectional surface is a circle or a rectangle. Further, it may be preferable that the length K of the introducing small tube is 0.1 mm to 10 mm and the cross sectional area S is $1.0\times10^{-1}$ to $1.0\times10^{-3}$ $mm^2$.

The ratio (W/R) of the distance W (an array pitch in the photosensitive material transport direction) between adjacent orifices of the ejection channel to the ejection end diameter of the orifice is preferably selected in the range of 5 to 30, and more preferably in the range of 10 to 25. When the ratio of (W/R) becomes excessively large, development unevenness tends to occur. On the contrary, when the ratio of (W/R) becomes excessively small, solution dripping due to mechanical resonance of the diaphragm crossing an ejection chamber, described below, tends to occur.

As the conversion element provided in the processing solution supplying means, other than those such as a spray bar, in which a processing solution is ejected by rapidly applying pressure to an ejection chamber, employing compressed air or a solenoid, a method is considered in which the processing solution is ejected by applying pressure to the interior of the ejection chamber due to volume variation caused by a piezoelectric element or bumping of a minute amount of the solution.

When a primary voltage element is employed, a piezoelectric element is preferably employed, because the size of the element is relatively small and the displacement amount (0.5 to 5.0 $\mu$m) which is sufficient to eject the processing solution can be obtained without applying a high voltage to the element as a driving voltage.

Employed as materials for the piezo element, as is well known, can be barium titanate, lead titanate, titanic acid, lead zirconate, and the like. The shape of the piezo element is columnar, and its cross section may be either circular or square. When an electric field is applied to the columnar piezo element, there is a large magnitude of distortion in the longitudinal direction of the element. The direction of the applied electric field may be the same as the oscillating (expansion and contraction) direction or may be orthogonal to the same.

The material of the member (a solution contacting section) in contact with a processing solution will be described below. The solution contacting section as described herein denotes a member in direct contact with particularly pressurized processing solution, which constitutes a solution supply channel from a tank (not shown), in which a processing solution is stored, to the ejection carried out by a processing solution supplying means. Specifically, the inlet of the ejection chamber, wall surface of the ejection chamber, wall surface forming the orifice, and the like of the processing solution supplying means are included.

Employed for this solution contacting section are suitably vinylidene chloride resins, vinyl chloride resins, epoxy resins, liquid crystal polyesters, polyimide resins, polyethylene, polyethylene terephthalate, polyphenylene sulfide and the like. Of ceramic and glass ceramic materials, suitable are FOTFORM Glass, FITOFORM OPAL GLASS-Ceramic, FOTOCREAM Glass-Ceramic (Hoya Glass) and the like. Of stainless steel materials, are acceptable SUS 302, SUS 303, SUS 304, SUS 304L, SUS 316, and the like. Further, employed can be nickel, tantalum Ta, chromium, silicone, silicone dioxide, and the like.

The supply rate of the processing solution applied (supplied) to a photosensitive material denotes the volume of the processing solution per second, which is supplied to the photosensitive material through ejection from orifices. In the present invention, with the intent of high rates of processing, the supply rate of the processing solution is preferably between 0.01 and 2.5 ml/second, and is more preferably between 0.1 and 1.0 ml/second. As the supply rate is lowered, processing speed decreases, while as the supply rate is excessively elevated, excessive supply may result. Therefore, considering these situations, specifically, the latter range is most preferred.

Distance Y between the ejection surface of an orifice and the emulsion surface of a photosensitive material is preferably between 50 $\mu$m and 10 mm, and is more preferably between 1 and 5 mm. When the distance to the photosensitive material is excessively short, the processing solution may be splattered: When the distance is excessively large, the straight movement of the processing solution may be lost. To satisfy the required conditions, the latter values are more acceptable.

(Heating Means of Photosensitive Material)

The automatic processor (a processing apparatus using a processing solution) preferably comprises a means to heat the photosensitive materials. Employed as the heating means can be heating drums, heating belts, dryers, infrared radiation, electromagnetic radiation utilizing high frequency, and the like. The photosensitive material may be heated at any time prior to the supply of the processing solution or after its supply. With the intent of high rates of processing, the photosensitive material is preferably heated prior to the supply of the processing solution, because the processing solution more smoothly penetrates into the photosensitive material.

The temperature of the photosensitive material itself, when heated, is preferably between 35 and 100° C. Further, with the intent of high rates of processing and the like, the temperature is more preferably between 40 and 80° C., because the heat resistance of the photosensitive material is degraded above 100° C. and the quick processability is not fully revealed until 35° C.

In order minimize any adverse effects to the emulsion surface of the photosensitive material being processed, the photosensitive material is preferably heated from the non-emulsion surface of the material.

(Photographic Processing Processes)

The automatic processor of the present invention is more preferably employed for photographic processing processes such as a development process, a color development process, a bleaching process, and the like, which result in dye formation and oxidation reaction, rather than those such as a bleach-fixing process, a fixing process, a stabilizing process, and the like, which remove unnecessary substances from the photosensitive material. Of these photographic processing processes, the black-and-white development process and color development process are preferred. Further, in order to minimize the formation of tar due to the oxidation of a developing agent, the automatic processor of the present invention is preferably employed particularly to the color development process.

(Processing Solutions)

The processing solutions employed in the present invention include not only ordinary processing solutions but also those which when used individually, cannot finish the processing reaction. Accordingly, the processing solutions include all solutions comprising components which can contribute to the processing of photosensitive materials, and further include mere water. The components which can contribute to processing of photosensitive materials include not only color developing agents and alkalis but also components such as surface active agents and the like, which make almost no contribution to the processing reactions.

The viscosity of the processing solution employed in the processing method of the present invention is generally between 1.2 and 10 cp at 25° C., is preferably between 1.5 and 8 cp, and is more preferably between 1.7 and 5 cp. When the viscosity of the processing solution is below 1.2 cp, the processing solution from the processing solution supplying means is not stably ejected into air. It has been found that, particularly when the processing solution is ejected, ejection stability is markedly enhanced by increasing the viscosity to at least 1.2 cp. The viscosity of most processing solutions is 1.2 cp or less. Accordingly, it is a surprising discovery that an increase in the viscosity enhances the ejection stability. Further, when a processing solution having a viscosity of at least 10 cp is supplied onto a photosensitive material through ejection, the processing rate decreases.

Cited as methods to control the viscosity of the processing solution, employed in the present invention, are those in which for example, a water-soluble polymer is incorporated into a processing solution in an amount in which the processing properties are not adversely affected; the concentration of salts is controlled within a range in which the processing properties are not adversely affected; or solvents, besides water, are incorporated in an amount in which the processing properties are not adversely affected. However, the present invention is not limited to these.

Water-soluble polymers, which may be employed in the present invention, include, for example, vinyl formas and derivatives thereof such as polyvinyl alcohols, polyvinylpyrrolidones, polyvinyl pyridinium halides, various types of modified polyvinyl alcohols, and the like; polymers containing an acrylic group such as polyacrylamides, polydimethyl acrylamides, polydimethylaminoacrylates, sodium polyacrylate, acrylic acid-methacrylic acid copolymer salts, sodium polymethacrylate, acrylic acid-vinyl alcohol copolymer salts, and the like; natural high polymer materials such as starch, oxidized starch, carboxyl starch, dialdehyde starch, cationic starch, dextrin, sodium alginate, gum arabic, casein, Pullulan, dextrin, methyl cellulose, ethyl cellulose, carboxymethyl cellulose, hydroxypropyl cellulose, and the like; synthesized polymers such as polyethylene glycol, polypropylene glycol, polyvinyl ether, polyglycerin, maleic acid-alkyl vinyl ether copolymers, maleic acid-N-vinyl pyrrole copolymers, styrene-maleic anhydride copolymers, polyethyleneimines, and the like. Of these polymers, preferred are polyvinylpyrrolidones, polyvinyl alcohols, and polyalkylene oxides.

Listed may be the above cited polyalkylene oxides, for example, polyethylene oxides, polyethylene glycol, polypropylene glycol or compounds represented by the general formula [P] described below:

General formula [P]

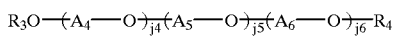

wherein $A_4$, $A_5$, and $A_6$ each represents a substituted or unsubstituted straight chain or branched chain alkyl group, and all do not represent the same group. $R_3$ and $R_4$ may be the same or different, and each represents a hydrogen atom, a substituted or unsubstituted alkyl group, aryl group, or acyl group.

Listed as substituted groups for each are a hydroxyl group, a carboxyl group, a sulfonyl group, an alkoxyl group, a carbamoyl group, and a sulfamoyl group. Listed as preferably employed are those in which $R_4$ and $R_5$ each represents a hydrogen atom, and $A_4$, $A_5$, and $A_6$ each represents an unsubstituted group. Those most preffered are ones in which $A_4$, $A_5$, and $A_6$ each represents $—CH_2CH_2—$ or $—CH(CH_3)—CH_2—$.

j4, j5, and j6 each represents an integer of 0 to 500, however, $j4+j5+j6 \geqq 5$.

Listed as solvents, besides water, which may be employed in the present invention are those which are compatible with employed processing solutions, and include, for example, alcohols such as methanol, ethanol, isopropanol, and the like; polyhydric alcohols such as ethylene glycol, diethylene glycol, glycerin, and the like; and organic amines such as triethanolamine, and the like; and the like.

Furthermore, the surface tension of the processing solutions employed in the present innovation is generally between 15.0 and 50.0 dyne/cm, and is preferably between 18.0 and 45.0 dyne/cm. When the surface tension is below the lower limit, the ejection stability of the processing solution is adversely affected, while when the surface tension exceeds the upper limit, process unevenness results due to the fact that when the processing solution is supplied onto a photosensitive material, said processing solution is not spread uniformly.

The automatic processor of the present invention may supply at one time a solution comprising all processing solution components required for the photographic processing process to a photosensitive material. Alternatively, the required components are incorporated into a plurality of solutions, each of which may be individually supplied to the photosensitive material. When a plurality of solutions are individually supplied, time necessary for completing the supply of all solutions is preferably as short as possible in terms of the high rates of the processing. Said time is preferably within 5 seconds, and is more preferably within one second. This is carried out so that no difference in processing reaction time results due to the difference in processing solutions. When a solution is separated into two types of solutions, as an example of a plurality of solutions, and is supplied to a photosensitive material, the two processing solution supplying means may be arranged in series along the transport direction of the photosensitive material.

The solute concentration of a processing solution employable in the automatic processor of the present invention is preferably between 0.2 and 20 percent by weight. Further, the solute concentration is more preferably between 0.4 and 20 percent by weight, and is most preferably between 1.0 and 10 percent by weight.

The supplied amount of the processing solution, from a processing solution supplying means, is preferably between 5 and 100 ml (milliliters) per $m^2$ of the photosensitive material, and is more preferably between 15 and 50 ml per $m^2$ from the viewpoint of the secured completion of the development process, minimization of solution dripping on the emulsion surface of a photosensitive material after the supply of the processing solution, and the like.

(Color Development Process)

As described above, the automatic processor of the present invention is preferably applied to a development process, and particularly to a color development process. A color developer may be divided into a plurality of partial composition solutions some of which may include a solution which is not capable of completing the color development reaction when employed individually. Accordingly, color developers as described herein include solutions such as a solution comprised of only a color developing agent and a preserver, a solution comprised of only an alkali, a solution comprised of only a surface active agent, mere water, and the like, each of which compose a portion of the color developer.

A processing solution which is capable of completing the color development reaction, when employed individually, may be applied to the emulsion surface of a photosensitive material. Alternatively, components required for color development reactions are incorporated into a plurality of different solutions and color development may be carried out by supplying them separately and mixing them on the emulsion surface. With the intent of rapid processing, color development is more preferred in which necessary components are incorporated into a plurality of solutions and the solutions are separately supplied so that it is possible to increase the concentration of specific components.

The processing time of color development is preferably between 3 and 30 seconds, is more preferably between 5 and 30 seconds to more stably complete color development reactions, and is most preferably between 8 and 20 seconds from the viewpoint of the degradation of and drying of the color developer.

The processing time of color development as described herein denotes time from the supply of the color developer onto a photosensitive material (an emulsion surface) until the processing solution which is employed in the subsequent process (for example, a bleaching process, or a bleach-fixing process) is supplied, or until the photosensitive material is immersed into a processing solution which carries out the subsequent process.

(Silver Halide Photosensitive Photographic Materials)

Employed as photographic materials which are processed by the automatic processor of the present invention can be silver halide photosensitive color photographic materials comprising silver iodobromide or silver bromide, silver halide photosensitive monochromatic photographic materials, and the like. Of these, preferred are silver halide photosensitive color photographic materials comprising silver chloride emulsion and silver halide photosensitive monochromatic photographic materials.

In the silver halide photosensitive photographic materials comprising silver chloride emulsion, are preferred those which comprise at least one emulsion layer composed of silver halide emulsion comprising silver chloride of at least 90 mole percent. From the viewpoint of processability, silver halide photosensitive photographic materials are preferred which comprise silver halide emulsion more preferably containing silver chloride between 95 and 100 mole percent, and most preferably between 98 and 100 mole percent.

EXAMPLES

The preferred embodiments of the present invention will be described below.

FIG. 1 is a schematic constitution view of the main portion of the automatic processor of the present invention. In the upper stream of the transport path of silver halide photosensitive photographic material P processed by processing solutions, there is heating means 110 which heats the silver halide photosensitive photographic material P. Part of the heating means 110 is heating drum 111. Furthermore, beneath the heating drum 111, there is exiting roller 112. In the left side of the heating drum 111, there is inlet guide roller 113. Below the inlet guide roller 113 in the left of the exiting roller 112, there is pressure contact belt driving roller 114. Pressure contact belt 115 is entrained about the exiting roller 112, the inlet guide roller 113 and the pressure contact belt driving roller 114. The pressure contact belt 115 is driven while being brought into pressure contact with the heating drum 111 over the 90 degrees of the circumferential surface of the heating drum 111 so that the photosensitive material P is transported while being brought into pressure contact with the heating drum 111 and is thereby heated.

In the downstream of the transport path of photosensitive material P of the heating drum 111, there is development means 120, which comprises processing solution tank 125 which supplies a first solution for processing photosensitive material P. The processing solution tank 125 is tightly sealed against ambient air. Color developer is supplied through air from the processing solution supplying means 1 to the emulsion surface of the photosensitive material P which has been heated by the heating means 110.

From the upper stream to the downstream of the transport path of the photosensitive material to which the processing solution has been supplied through air employing the processing solution supplying means 1, there is second heating means 130 which further heats photosensitive material P. The second heating means 130 comprises heating roller 131, driving roller 132, and heating belt 133. The heating belt 133 is entrained over the heating roller 131 and the driving roller 132. The heating roller 131 is located in the upper stream in the transport path of said photosensitive material P to which the processing solution is supplied through air employing the processing solution supplying means 1, and heats the heating belt 133.

The driving roller 132 located in the downstream in the transport path of the photosensitive material P from the heating roller 131 drives the heating belt 133. By so doing, the photosensitive material P is heated while the heating belt is being heated. A processing solution is supplied through air to the emulsion surface of photosensitive material P, which is further heated employing the second heating means 130. Furthermore, the photosensitive material P, in which the processing solution has been applied to its emulsion surface, is further heated employing the second heating means 130.

Thereafter, the photosensitive material P which subjected to color development employing the development means 120 is further subjected to bleach-fixing in bleach-fixing tank BF and stabilizing in stabilizing tank ST.

The emulsion surface temperature of the photosensitive material is raised to 60° C. employing the heating drum 111 of which surface temperature is maintained at 60° C. Furthermore, the surface temperature of photosensitive material P is also maintained at 50° C. due to heating it from the support surface employing the heating belt 133 of which surface temperature is maintained at 50° C.

Figure 2:
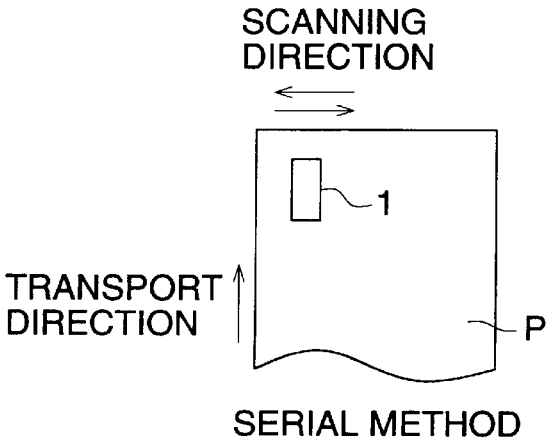
FIGS. 2(A) and 2(B) are views showing the difference of the scanning method of a means for supplying a processing solution.
Figure 2:
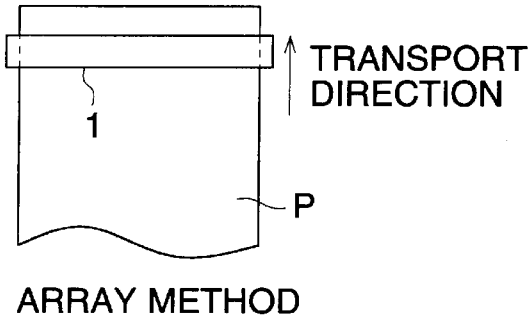

As shown in FIG. 2A, a serial method may be applied to the processing solution supplying means 1 employed in the present embodiment, or as shown in FIG. 2B, an array method may be applied to the same. In the case of the serial method, during the reciprocation of the processing solution supplying means 1 in the horizontal direction, the necessary amount of processing solution is evenly applied (supplied) onto photosensitive material P by continually transporting the photosensitive material P in the arrowed directions. In the array method, because a processing solution is simultaneously ejected along one line, the processing solution supplying means may be fixed.

Figure 3:
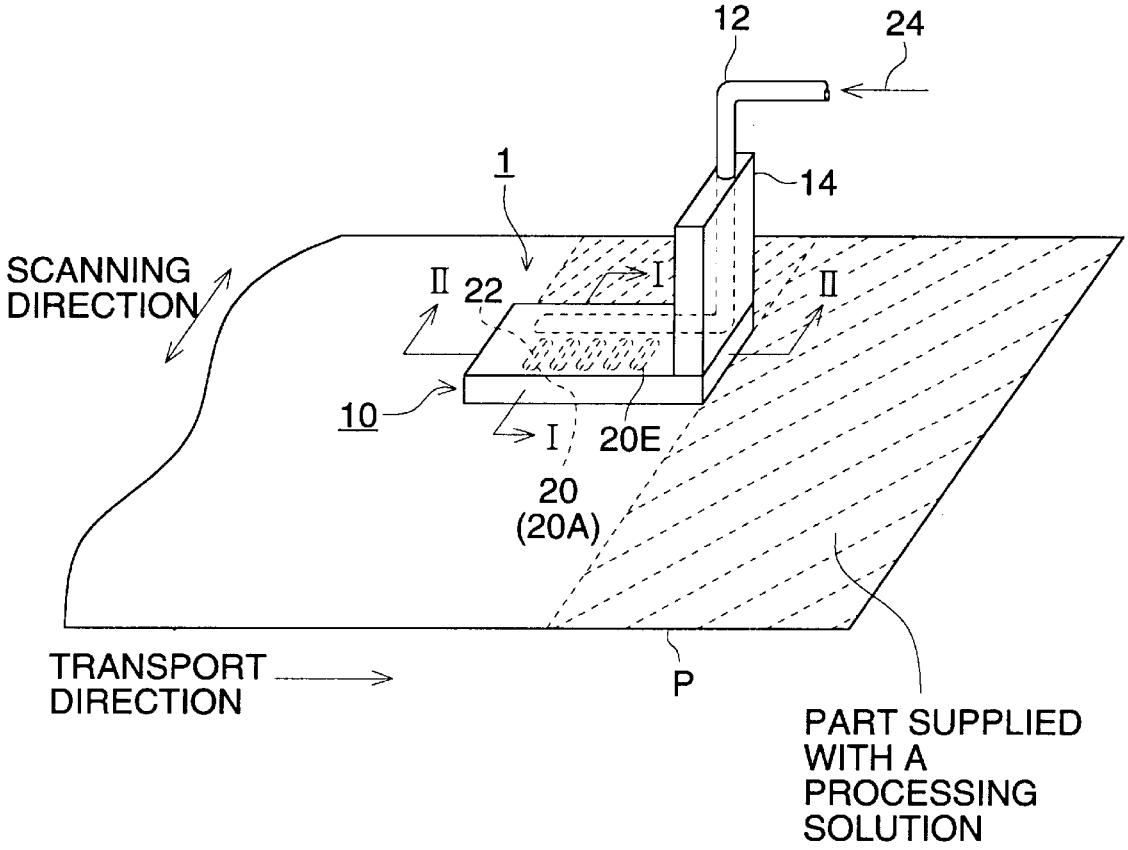
FIG. 3 is a view showing the relationship between the means for supplying a processing solution and the photosensitive material.

The embodiment described below is a processing solution supplying means 1 to which the serial method shown in FIG. 2A is applied, one example of which is shown in FIG. 3. The processing solution supplying means 1, as shown in FIG. 3, is composed of processing solution supply main body (a head main body) 10 and holding means 14 which holds processing solution supply pipe 12. Though the details of the scanning drive means of the processing solution supplying means are not shown in the figure, this may be realized by employing a belt drive, gear (rack and pinion series) drive, and the like. Which are well known in the art.

In the processing solution supply main body 10, a plurality of ejection channels 20 are arranged. In the embodiment, five ejection channels 20A through 20 E are parallel arranged at equal distance in an array, and the specified amount of processing solution 24 is ejected at a specified rate onto the photosensitive material from a plurality of ejection nozzles (orifices) arranged in each of the ejection channels 20A through 20E, for example, with five orifices in line. The cross section of the orifice 22 is a circle, and may be an ellipse or a square.

Figure 4:
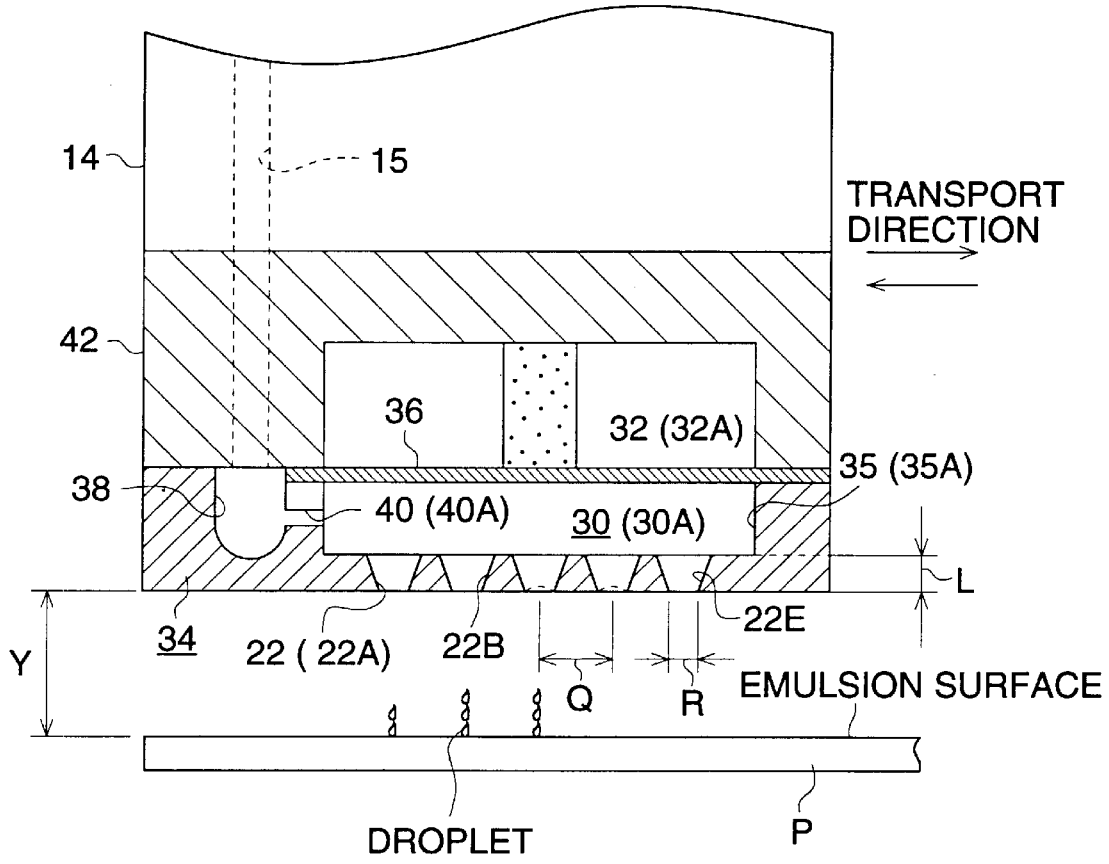
FIG. 4 is a cross-sectional view on the I—I line of FIG. 2.

Details of the processing solution supply main body are shown in FIG. 4, and the following figures.

Figure 5:
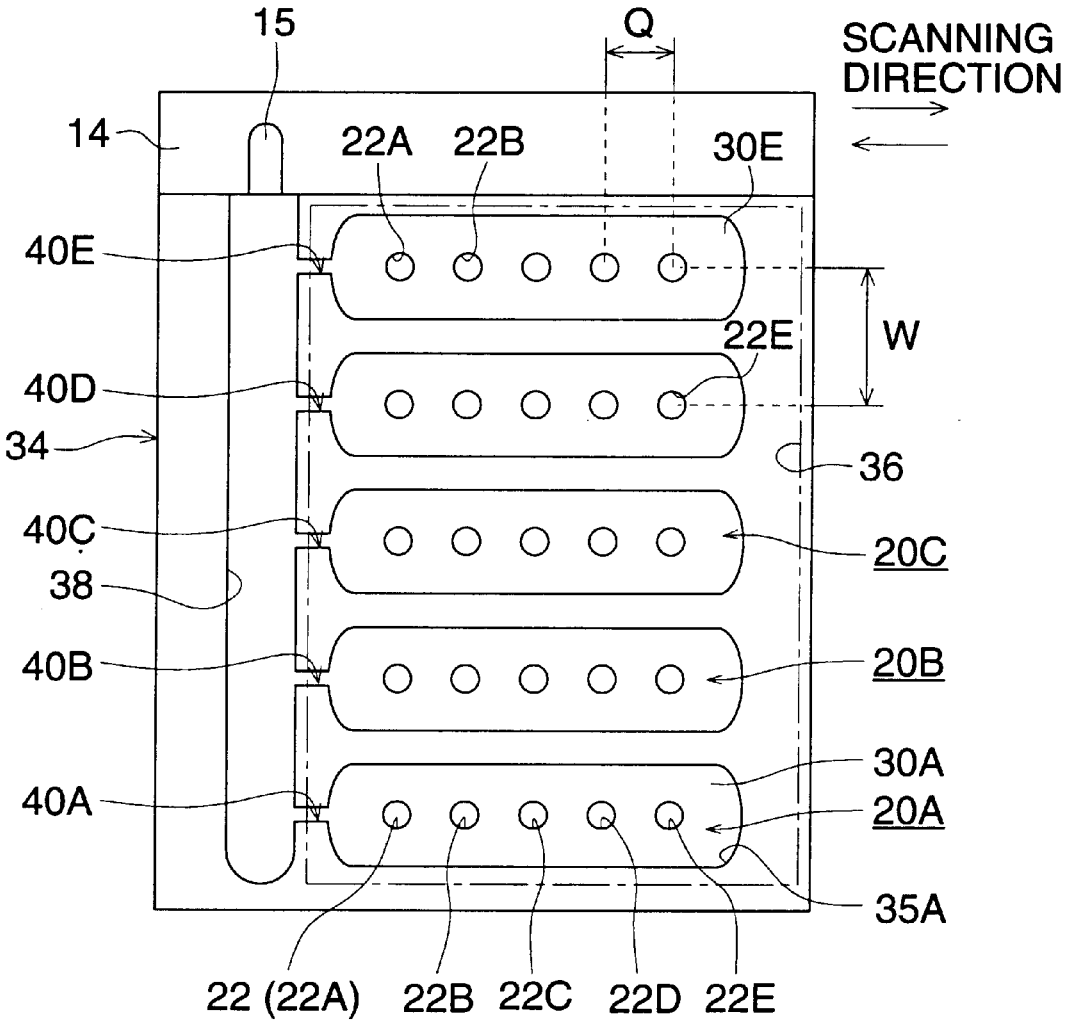
FIG. 5 is a top view in which a part of FIG. 2 is removed.
Figure 6:
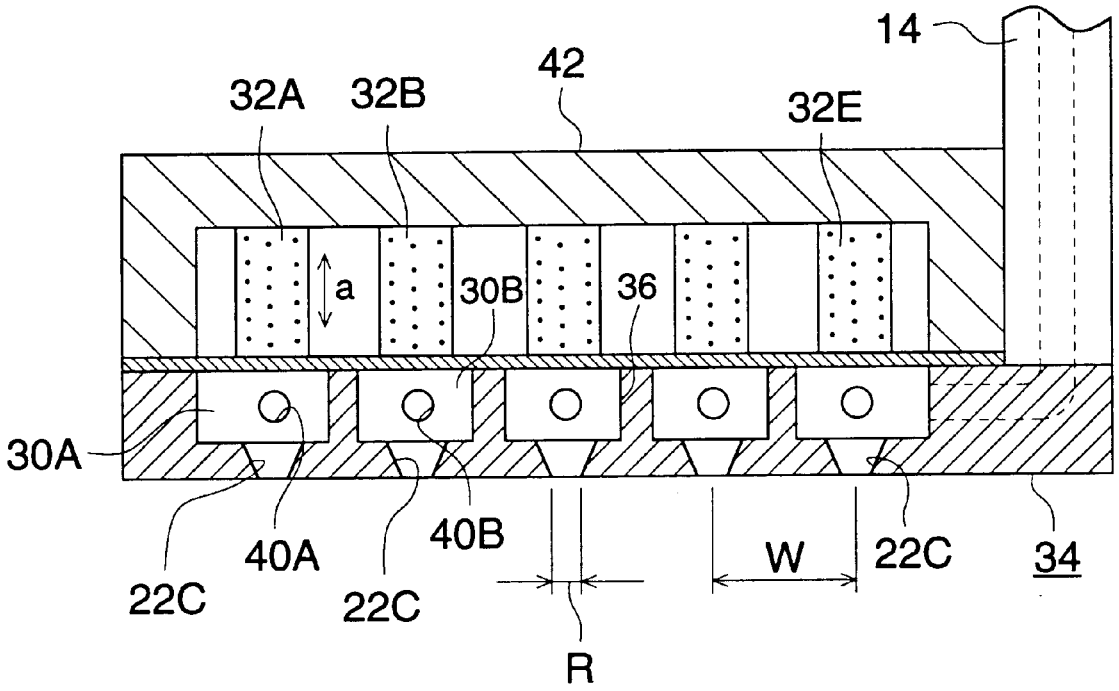
FIG. 6 is a cross-sectional view on II—II line of FIG. 2.

FIG. 4 is a cross-sectional view on I—I line in FIG. 3, FIG. 5 is its top view, and FIG. 6 is a cross-sectional view on II—II line in FIG. 3. Because the constitution of five ejection channels 20A through 20E is identical, FIG. 3 only shows one ejection channel 20A.

This ejection channel 20A is composed of ejection chamber 30A into which processing solution 24 (refer to FIG. 3) is injected, five orifices (nozzles) 22A through 22E, connected to the ejection chamber 30A, and conversion element 32A which varies the volume of the ejection chamber 30A.

Figure 11:
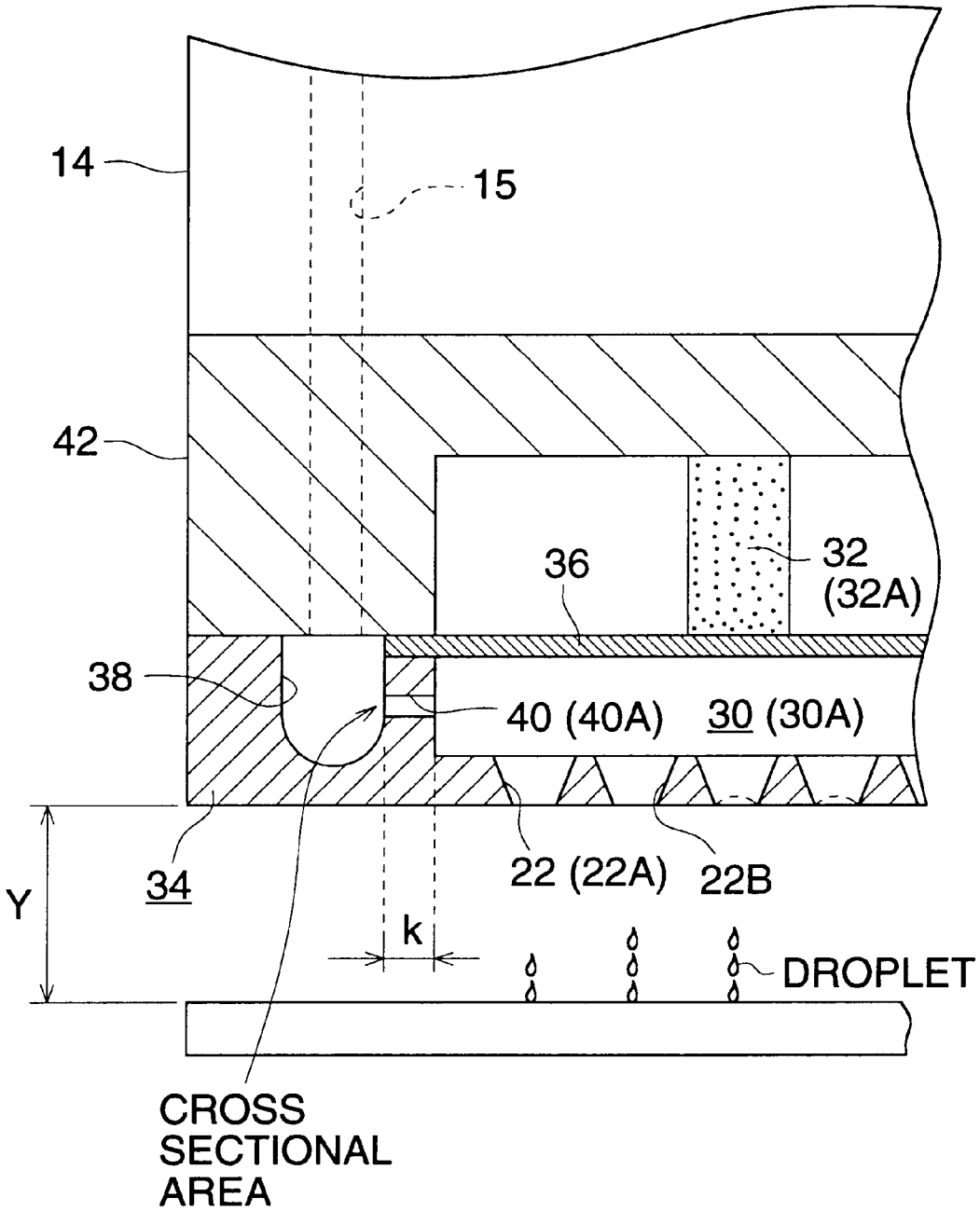
FIG. 11 is a cross sectional view showing a narrowed flow passage.

The interior surface of the orifice main body 34 is provided with the recessed section 35A of the ejection chamber 30A, and the plurality of orifices 22A through 22E are bored only in a straight line having an equal pitch Q on the bottom surface of the recessed section. Furthermore, an oscillating plate 36 in this example, is pasted on so as to block off this ejection chamber 30A, and in the example shown in the figure, hollow section 38 arranged in the left side section of the orifice main body 34 is employed as a buffer tank. This buffer tank 38 is connected to the ejection chamber 30A through processing solution supply hole (small hole) 40A in which the flow passage area is narrowed as shown in FIG. 11. Solution supply communicating hole 15 is bored between the buffer tank 38 and supporting member 14.

Processing solution 24 supplied from a processing solution tank (not shown) is temporarily stored in the buffer tank 38, and a part of the stored processing solution 24 is injected into the ejection chamber 30A via the supply opening 40A. The processing solution 24 is injected so as to fill up the interior of the ejection chamber 30A.

Figure 12:
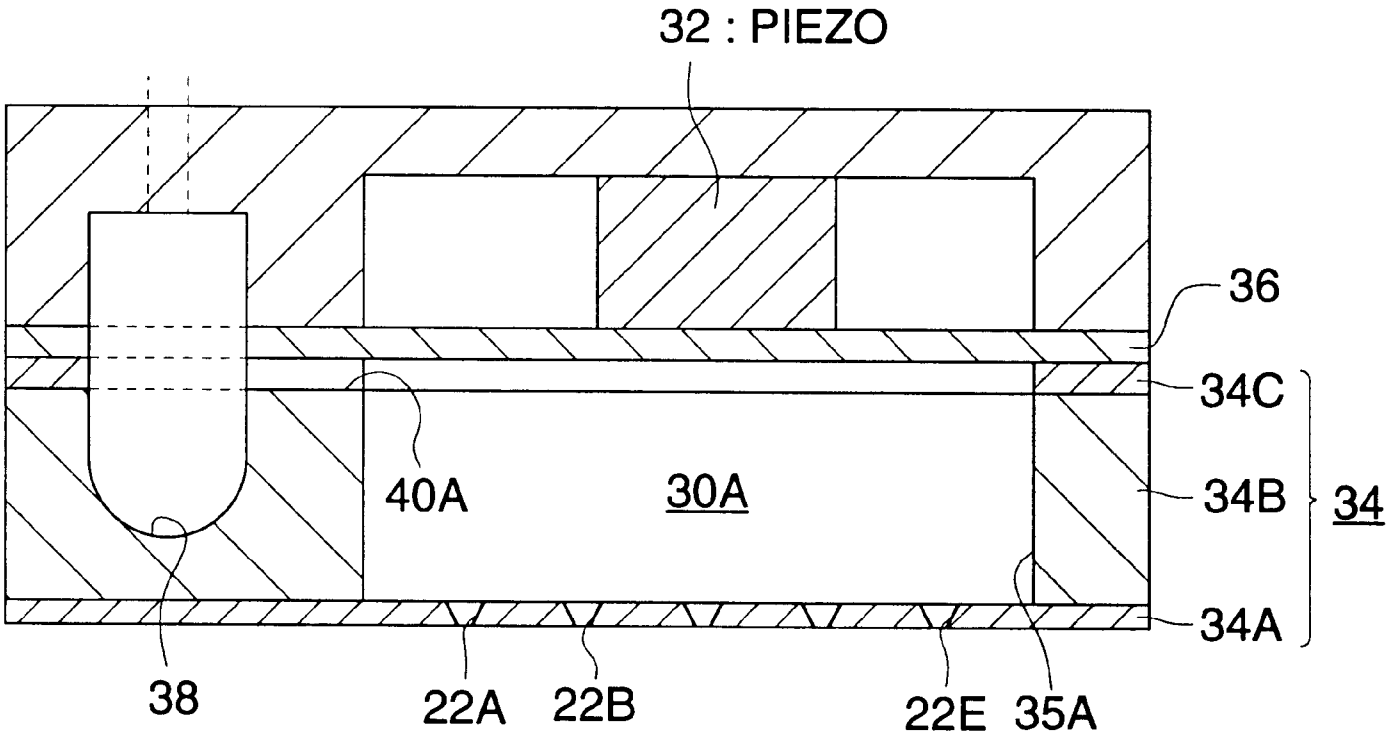
FIG. 12 is a cross sectional view showing an orifice main body.

The orifice main body 34 may be constructed in the superimposed layer structure as shown in FIG. 12. FIG. 12 is a cross sectional view of the ejection channel 20A. The following explanation is made with reference to FIG. 13, the orifice main body 34 is constructed by the orifice plate 34A (see FIG. 13(A)) on which only plural pieces of orifices 22 arranged with a predetermined pitch are formed, an intermediate plate 34B (see FIG. 13 (B)) to form a recessed section 35A and a recessed section for the buffer tank 38 and an introducing small conduit forming plate 34C (see FIG. 13(C)) superimposed at the upper layer section on the intermediate plate.

The introducing small conduit forming plate 34C is provided integrally with a void section used as a part of the recessed section 35A. Slits to communicate with the buffer tank 38 are formed on a part of it. These slit function as introducing small conduits 40A, 40B . . . Among these plates, a stainless plate (SUS plate) is used for the intermediate plate 34B and the introducing small conduit forming plate 34C due to the reasons of anti-corrosion and manufacturing accuracy.

Orifices 22A through 22E are tapered as shown in FIGS. 4 and 6 and its thickness L is the orifice length. The orifices are tapered so that air bubbles are not included into the ejection chamber even when the solution surface in the aperture section of the orifice assumes broken-line shape, shown in FIG. 4, due to the surface tension of the processing solution 24, along with the selection of diameter R. Due to this, during continuous ejection, no air bubbles enter the ejection chamber 30A.

Each of the above-mentioned conversion elements 32A through 32E is arranged to be nearly central, in this example, just above orifices 22, of ejection chambers 30A through 30E which are arranged in each of the ejection channel 20A though 20E via the oscillating plate 36 which is to each, as shown in FIG. 6. In this example, piezoelectric elements are employed as conversion elements 32A through 32E.

As also shown in FIG. 6, piezoelectric elements in the form of a square block are employed, one end of which is fixed on the oscillating plate 36, while the other end is fixed on the supporting member 42 formed in a hollow section.

Figure 7:
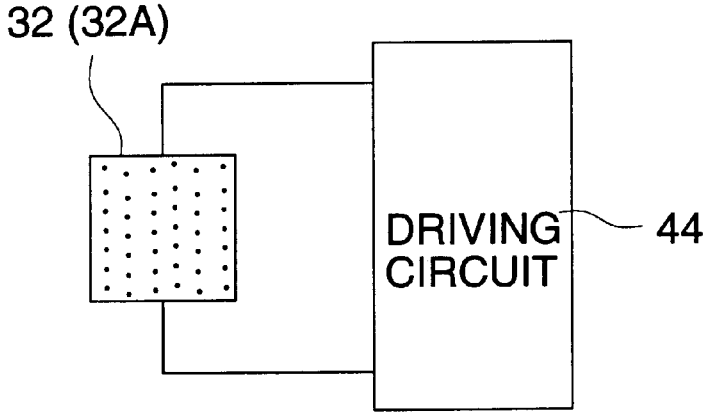
FIG. 7 is a view showing a piezoelectric element employed as a conversion element and its driving circuit.

As shown in FIG. 7, when predetermined voltage is applied to piezoelectric element 32A employing a driving circuit (a pulse generating circuit), the square block piezoelectric element 32A expands and contracts in the arrowed direction due to the piezo effect, as shown in FIGS. 6 and 8.

Because such expansion or contraction is directly transmitted to oscillating plate 36, the oscillating plate 36 shifts toward the ejection chamber 30A. This shift causes the volume change in the ejection chamber 30A. That is, the resulting deformation of the oscillating plate 36 results in capacity variation (volume variation) in the ejection chamber 30A, which results in strong pressure variation to the contained processing solution 24. The processing solution 24 is ejected from orifices 22A through 22E due to such pressure variation. When the processing solution 24 is ejected, the pressure in the ejection chamber 30A decreases, and the processing solution 24 is replenished from the buffer tank 38 through the supply opening 40A. As the expansion or contraction of the piezoelectric element is repeated, the processing solution 24 is continually ejected from the orifices 22A through 22E. As the frequency of driving pulses Pa and Pb is raised, the ejected processing solution is transformed into solution droplets.

Accordingly, the length L and diameter R of orifices 22A through 22E, the ejection rate of the processing solution 24, and the like, as described above, are factors which contribute to the supplied amount of the processing solution to photosensitive material P, and to optimal ejecting conditions.

Stainless steel and the like are applied to the wall surface of the ejection chamber 30A and the like, which are in contact with the processing solution 24. As described above, employed as stainless steel can be SUS 304L and the like. In the same manner, SUS 304L is used for the wall surfaces of orifices 22A through 22E.

The oscillating plate 36 is adhered to the orifice main body 34 and supporting member 42, employing, for example, an epoxy resin adhesive agent. The oscillating plate 36 can be composed of a sheet material, such as SUS 304L.

Five conversion elements 32A through 32B installed in each of ejection channels 20A through 20E described above are originally driven simultaneously. However, by so doing, there is the possibility that the oscillating plate 36 is subjected to resonance due to their mutual vibration. Such resonance phenomenon is avoided in such a manner that a phase difference $\phi$ is formed between driving pulse Pa applied to conversion elements 20A, 20C, and 20E having the odd number in the order and driving pulse Pb applied to conversion elements 20B and 20D having the even-number in the order.

One cycle is $2\pi$, and $2\pi=360°=0°$. Therefore, the phase difference $\phi$ can take a range of 10° to 180° . In such a range, the range of 90° to 180° is preferred so as to enable the resonance phenomenon to be minimized. FIG. 9, for example, shows a case in which driving is carried out at a phase difference of 180° by which effects due to resonance are minimized.

Driving pulses Pa and Pb are preferably frequencies of about 1 KHz to about 10 KHz. Furthermore, the duty of driving pulses Pa and Pb is preferably about 1:5, when the pulse width is represented by Px. The voltage of driving pulses Pa and Pb is determined depending on the characteristics of employed piezoelectric elements and displacement amount based on the degree of expansion and contraction.

Figure 10:
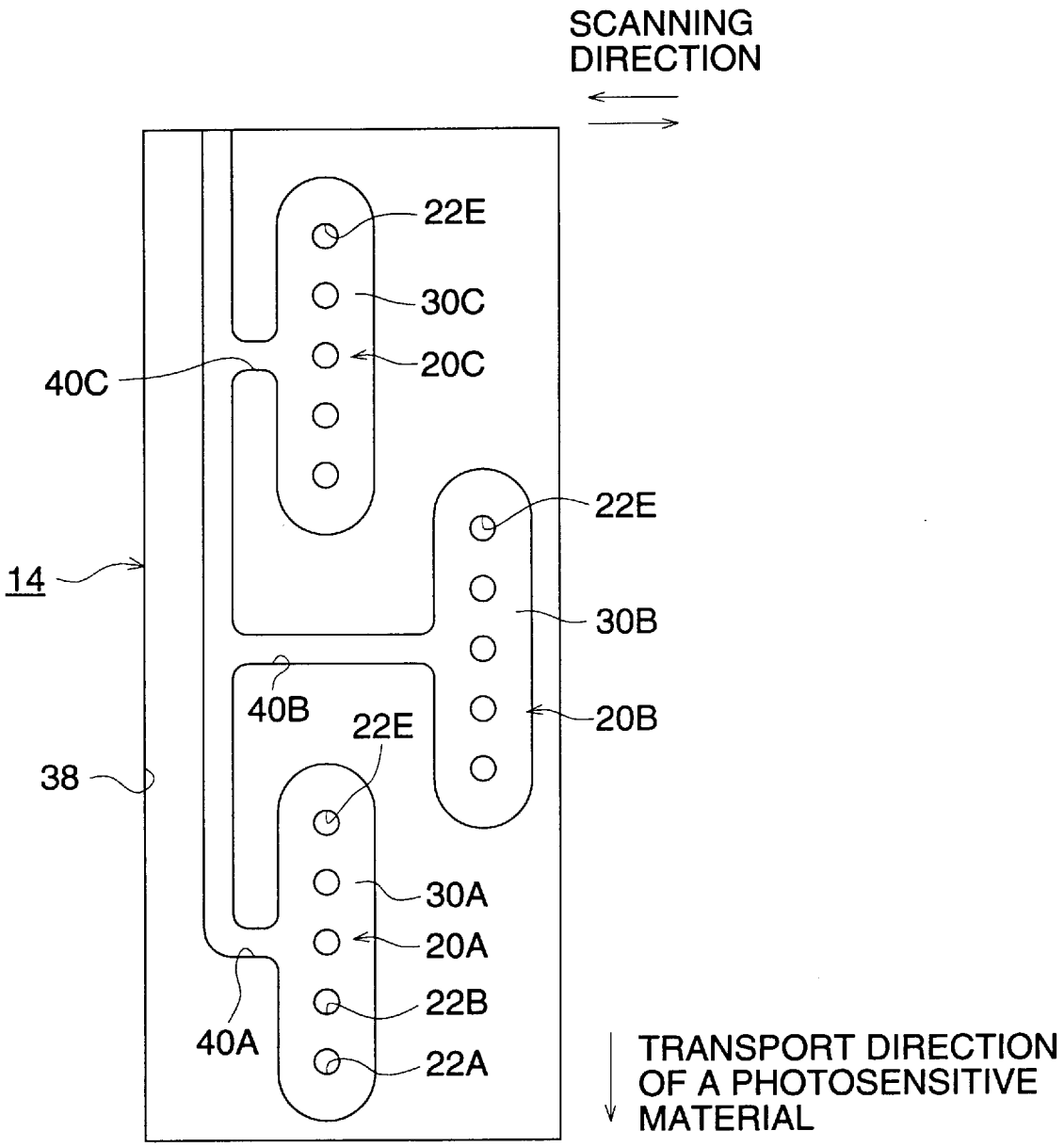
FIG. 10 is a partial top view which is the same as FIG. 6, showing another embodiment of ejection channels.

The ejection channels 20 may be arranged in such a manner that, as shown FIG. 10, the ejection channels having even number in the order are offset from ones having the odd number.

Further, an ejection test of the processing solution was carried out, employing the processing solution supplying means 1, which was constituted as described above.

(Processing Solution Example 1)

(color developer formula described below was employed for preparing 1 liter of the solution)

| | |
|---|---|
| Sodium sulfite | 0.1 g |
| Pentasodium diethylenepnentaaminepentaacetate | 3.0 g |
| Polyethylene glycol #4000 | 5 g |
| Bis (sulfoethyl)hydroxylamine disodium | 16 g |
| Tinopal SFP | 2 g |
| Potassium carbonate | 33 g |
| Sodium p-toluenesulfonate | 20 g |
| CD-3 | 12 g |
| Potassium hydroxide | 8 g |

The pH was adjusted to 11.0 employing potassium hydroxide or sulfuric acid.

Along with employing the developer described above, the processing solution was ejected onto photosensitive material P, employing piezoelectric elements under a driving pulse having a frequency of 8 KHz in serial method processing solution supplying means 1. Measurements were carried out at a driving voltage of 80 V while regulating the phase difference between driving pulse Pa and Pb to 0°. The processing solution supplying means 1 was employed, which had a total of 32 ejection channels and 256 orifices. Employed as the orifice pattern was the one shown in FIG. 4. In each ejection channel 20, the distance between orifices was set at 0.3 mm and the orifice pitch Q of the adjacent channel was 1 mm. Further, the processing solution supplying means 1 was structured so that the orifice length L and orifice diameter R were varied as described in Table 1 below, and experiments were carried out in which photosensitive materials exposed through an ordinary wedge were processed. Table 1 shows the results.

Further, after the color development, processes described below were carried out.

(a) Bleach-fixing Process, Stabilizing Process

Processing was carried out under Konica Corp. Process CPK-2-28 processing conditions employing the processing solution for the same.

(b) Processing time

| Processing Step | Processing Time |
|---|---|
| Color development | 8 seconds |
| Bleach-fixing | 27 seconds |
| Stabilizing | 27 seconds × 3 |

(c) Photosensitive Materials

QA Paper Type A6 manufactured by Konica Corp. (having an emulsion layer comprising silver halide emulsion in which at least 99.9 percent is silver chloride), which had been exposed employing a conventional method, was processed.

(d) Heating conditions

The surface temperature of the photosensitive material was raised to 60° C. employing a heating drum of which surface temperature was maintained at 60° C.

The maximum spectral reflection density Dmax at 440 nm of the processed photosensitive material was measured. Further, after processing, staining on the surface of orifice main body 34 of the ejection head was visually observed and evaluated according the evaluation standards stated below.

A: no staining due to the processing solution was observed

B: slight staining due to the processing solution was observed, however, not in the range to cause problems for commercial viability C: staining resulted at a level to be unsuitable for commercial viability

TABLE 1

| Experiment No. | Orifice Length (mm) | Orifice Aperture Diameter R (μm) | Ratio L/R | Developed Color Density Dmax (Y) | Staining of Orificie Main Body 34 | Remarks |
|---|---|---|---|---|---|---|
| 1-1 | 0.05 | 50 | 1 | 0.50 | C | comparative |
| 1-2 | 0.1 | 50 | 2 | 0.80 | B | comparative |
| 1-3 | 0.3 | 50 | 6 | 1.90 | A–B | present invention |
| 1-4 | 0.5 | 50 | 10 | 2.05 | A | present invention |
| 1-5 | 1.0 | 50 | 20 | 2.20 | A | present invention |
| 1-8 | 2.5 | 50 | 50 | 2.20 | A | present invention |
| 1-9 | 5.0 | 50 | 100 | 2.08 | A | present invention |
| 1-10 | 10.0 | 50 | 200 | 1.95 | A | present invention |
| 1-11 | 10.0 | 40 | 250 | 1.70 | B–C | comparative |
| 1-12 | 1.0 | 30 | 33 | 2.20 | A | present invention |
| 1-13 | 1.0 | 70 | 14 | 2.15 | A | present invention |
| 1-14 | 1.0 | 100 | 10 | 2.08 | A | present invention |
| 1-15 | 1.0 | 220 | 4 | 0.95 | B | comparative |

As shown in Table 1, it is found that sufficient ejection is obtained in the range of the ratio of the orifice length L to the orifice diameter R of 5 to 200; the stable ejection is maintained; the orifice main body 34 is not stained, and effects of the present invention are effectively exhibited.

Subsequently, in Experiments No. 1 through 3 in Table 1, similar experiments were carried out as shown in Table 2, while the phase difference was applied to driving pulses Pa and Pb to the conversion elements.

TABLE 2

| Experiment No. | Phase Difference (degrees) | Dmax(Y) | Staining of Orifice Plate |
|---|---|---|---|
| 2-1 | 0 | 1.90 | A–B |
| 2-2 | 5 | 1.92 | A–B |
| 2-3 | 10 | 2.10 | A |
| 2-4 | 45 | 2.10 | A |
| 2-5 | 90 | 2.15 | A |
| 2-8 | 180 | 2.15 | A |

Through providing at least 10° of the phase difference at the adjacent channels, the ejection amount increases and staining of the orifice main body (orifice plate) 34 decreases.

Subsequently, in Experiments No. 1 through 3 in Table 1, experiments were carried out varying the number of orifices 22 employing the processing solution supplying means 1 having 32 ejection channels. As the orifice pattern, the one shown in FIG. 4 was employed. In each ejection channel, the spacing between orifices was 0.3 mm and the orifice pitch of the adjacent channel was varied as shown in Table 3.

The orifice spacing Q was 100 $\mu$m (the area is $7.85\times10^{-9}$ $mm^2$) while making the ejection side as the reference, and the frequency of the processing solution supply was 7,000 per second. The amount supplied to photosensitive material P was set at 0.07 ml/second. Further, the supplied amount to the photosensitive material P was 20 ml per $m^2$. Orifices of length L of 1 mm and orifice diameter R of 0.05 mm were employed.

Further, photosensitive materials which had been exposed through a conventional wedge were processed and the maximum spectral reflection density Dmax(Y) was measured. Furthermore, the degree of spot blotches was observed. In the present examples, Dmax (Y) exceeding 2.0 was evaluated as sufficient density. Table 3 shows the results.

TABLE 3

| Experiment No. | Number of Orifices in Channel | Q/R | Clogging | Dmax (Y) | Spot Blotches | Remarks |
|---|---|---|---|---|---|---|
| 3-1 | 1 | 20 | A | 1.50 | B | comparative |
| 3-2 | 2 | 20 | A | 1.95 | A | present invention |
| 3-3 | 3 | 20 | A | 2.05 | A | present invention |
| 3-4 | 4 | 20 | A | 2.10 | A | present invention |
| 3-5 | 8 | 20 | A | 2.10 | A | present invention |
| 3-7 | 8 | 1 | B | 2.0 | A | present invention |
| 3-8 | 8 | 2 | A | 2.07 | A | present invention |
| 3-9 | 8 | 5 | A | 2.10 | A | present invention |
| 3-10 | 8 | 10 | A | 2.10 | A | present invention |
| 3-12 | 8 | 25 | A | 1.95 | A–B | present invention |
| 3-13 | 8 | 30 | A | 1.8 | B | present invention |

After processing, all orifices were subjected to ejection tests and the degree of orifice clogging was evaluated according to the evaluation standards stated below.

A: ejection was observed from all orifices

B: ejection direction from one or two orifices was not normal

C: no ejection was observed from one or two orifices, due to clogging.

Spot blotches were visually evaluated as follows:

A: no formation of spot blotches

B: some spot blotches resulted, though these caused no problem for commercial viability As can clearly be seen also from the results of this experiment, it is found that when as the number of orifices of the ejection channel, at least two are chosen, developed color density increases and the formation of spot blotches is minimized.

Furthermore, as described below, the same experiment was carried out while varying the supplied amount of a processing solution per second as shown in Table 4. The incomplete color formation at ends of photosensitive material P was evaluated according to the standards stated below:

A: no problem was observed

B: slight incomplete color formation was observed at ends

C: incomplete color formation was clearly observed and was at a level to cause problems The orifice clogging was evaluated as follows:

A: ejection was observed from all orifices

B: ejection direction from one or two orifices was not normal

C: no ejection was observed from one or two orifices, due to clogging.

TABLE 4

| Experiment No. | Supplied Amount of Processing Solution per Second (ml) | Incomplete Color Formation at Ends of Photosensitive Material | Clogging | Dmax(Y) |
|---|---|---|---|---|
| 4-1 | 0.05 | A | A | 1.80 |
| 4-2 | 0.01 | A–B | A | 1.95 |
| 4-3 | 0.02 | A–B | A | 2.05 |
| 4-4 | 0.08 | A–B | A | 2.10 |
| 4-5 | 0.10 | A | A | 2.15 |
| 4-7 | 0.20 | A | A | 2.15 |
| 4-8 | 0.08 | A | A | 2.15 |
| 4-9 | 1.0 | A | A | 2.15 |
| 4-10 | 2.0 | A | A | 2.10 |
| 4-12 | 2.5 | A | A–B | 2.10 |
| 4-13 | 3.0 | A | B | 2.08 |

As can be seen in the above results, by setting the supplied amount of the processing solution between 0.01 and 2.5 ml per second, incomplete color formation at the ends of photosensitive material P is improved and the clogging of the orifices 22 is also minimized. Furthermore, it is found that developed color density increases.

Subsequently, similar experiments were carried out while varying the supplied amount per $m^2$ of the photosensitive material. Table 5 shows the results. After processing, staining in the transport section of a color development process was evaluated according to the evaluation standards stated below.

A: staining due to dripping of the processing solution was not observed

B: slight staining due to dripping of the processing solution was observed

C: staining due to dripping of the processing solution was clearly observed and exceeded the commercially viable limit

TABLE 5

| Experiment No. | Supplied Amount per $m^2$ of Photosensitive Material | Staining of Transport Section | Clogging | Dmax(Y) |
|---|---|---|---|---|
| 5-1 | 4 | A | A | 1.90 |
| 5-2 | 5 | A | A | 1 95 |
| 5-3 | 8 | A | A | 2.05 |
| 5-4 | 10 | A | A | 2.10 |
| 5-5 | 15 | A | A | 2.05 |

TABLE 5-continued

| Experiment No. | Supplied Amount per $m^2$ of Photosensitive Material | Staining of Transport Section | Clogging | Dmax(Y) |
|---|---|---|---|---|
| 5-7 | 20 | A | A | 2.07 |
| 5-8 | 50 | A | A | 2.10 |
| 5-9 | 60 | A–B | A | 2.10 |
| 5-10 | 90 | A–B | A | 2.10 |
| 5-12 | 100 | A–B | A | 2.10 |
| 5-13 | 120 | B | A–B | 2.08 |

As can be seen in the above-cited results, by setting the supplied amount of the processing solution between 5 and 100 ml per $m^2$, staining of the photosensitive material transport section is reduced; clogging of orifices 22 is minimized, and the developed color density is enhanced.

Experiments similar to those shown in Table 1 were carried out while concentrating the above-mentioned Processing Solution Example 1 and varying the solute concentration as shown in Table 6.

TABLE 6

| Experiment No. | Solute Concentration of Processing Solution (percent by weight) | Average Dot Amount (nanograms) | Staining of Orifice Main Body | Clogging |
|---|---|---|---|---|
| 6-1 | 0.1 | 65 | A–B | A–B |
| 6-2 | 0.2 | 65 | A | A–B |
| 6-3 | 0.4 | 65 | A | A–B |
| 6-4 | 1.0 | 65 | A | A |
| 6-5 | 10 | 65 | A | A |
| 6-8 | 20 | 55 | A | A–B |
| 6-9 | 30 | 45 | A–B | B |

As can be seen in the above-mentioned results, by setting the solute concentration of the processing solution to at least 0.2 percent by weight, clogging is minimized, and the average dot amount is enhanced. Thus, more desirable effects of the present invention are exhibited.

Next, in Experiments No. 1–3 in Table 1, similar experiments were carried out by adjusting the viscosity of the processing solution as indicated in Table 7. The viscosity adjustment was conducted by adjusting an adding amount of Diethylene glycol (DEG).

The test results are shown in Table 7. The evaluation for this test result is conducted with the same manner in Table 1.

TABLE 7

| Experiment No. | Adding Amount of DEG (g/l) | Viscosity (cp) | Developed Color Density Dmax (Y) | Irregularities in Development | Staining of Orifice Plate |
|---|---|---|---|---|---|
| 7-1 | 0.0 | 1.10 | 1.90 | B | B |
| 7-2 | 5 | 1.20 | 2.05 | B–A | B–A |
| 7-3 | 10 | 1.50 | 2.05 | A | B–A |
| 7-4 | 17 | 1.8 | 2.10 | A | B–A |
| 7-5 | 25 | 2.0 | 2.10 | A | A |
| 7-6 | 50 | 2.5 | 2.10 | A | A |
| 7-7 | 100 | 3.0 | 1.95 | A | A |
| 7-8 | 150 | 5.3 | 1.95 | A | A |

TABLE 7-continued

| Experiment No. | Adding Amount of DEG (g/l) | Viscosity (cp) | Developed Color Density Dmax (Y) | Irregularities in Development | Staining of Orifice Plate |
|---|---|---|---|---|---|
| 7-9 | 220 | 8.0 | 1.90 | B–A | A |
| 7-10 | 300 | 9.5 | 1.8 | B | B–A |

As can be seen from (Table 7), by adjusting the viscosity of the processing solution to be within a range of 1.5 to 8 cp, an excellent developed color density can be obtained, irregularities in development can be prevented, and staining of orifice plate can be reduced.

As described above, according to the present invention, marked effects as described below can be exhibited.

First, in the case of ejecting a processing solution for silver halide photosensitive photographic materials, a large ejection amount is stably obtained and high speed processing can be achieved.

Secondly, due to no formation of spot blotches, high quality development process can be realized. Thirdly, during ejection from all orifices, the ejection direction is normal and the orifice main body (plate) composing orifices is not stained. Thus, the maintenance properties can be markedly improved.

Fourthly, even during use over a long period of time, orifice clogging tends not to occur. Further, this invention is characterized in that being capable of decreasing solution waste, an automatic processor for silver halide photosensitive photographic materials, which is friendly to the environment, can be provided.

What is claimed is:

1. An apparatus for automatically processing a silver halide photographic light sensitive material by plural processes, comprising:

a conveyor for relatively conveying the material to the plural processes; and processing solution supplying means for supplying a processing solution onto the material in at least one of the plural processes, the processing solution supplying means having plural jetting channels, each jetting channel comprising a jetting chamber in which the processing solution is accommodated, a jetting head provided with plural orifices each communicating with the jetting chamber, and a converting element to change the volume of the jetting chamber so that the processing solution is jetted through the plural orifices from the jetting chamber to an outside, wherein each orifice has a length L and a diameter R and a ratio (L/R) is made within a range of 5 to 200.

2. The apparatus of claim 1, wherein the converting element is a piezo element.

3. The apparatus of claim 1, wherein a timing to change the volume of the jetting chamber in a jetting channel has a phase difference for that in its neighboring jetting channel.

4. The apparatus of claim 3, wherein the phase difference is not smaller than 10°.

5. The apparatus of claim 1, wherein the plural orifices are arranged with a pitch W in such a manner that a ratio (W/R) is made within a range of 2 to 25.

6. The apparatus of claim 1, wherein the processing solution supplying means supplies the processing solution with an amount set within a range of 0.01 ml/sec to 2.5 ml/sec.

7. The apparatus of claim 1, further comprising:

heating means for heating the material to 35° or more.

8. The apparatus of claim 1, wherein the processing solution supplying means supplies the processing solution with an amount set within a range of 5 ml to 100 ml per 1 $m^2$ of the material.

9. The apparatus of claim 1, wherein a concentration of solute in the processing solution is 0.2 weight·% or more.

10. The apparatus of claim 1, wherein the processing solution is a color developing solution.

11. The apparatus of claim 1, wherein a viscosity of the processing solution is 1.2 and 10 cp at 25° C.

12. The apparatus of claim 11, wherein the viscosity of the processing solution is 1.5 and 8 cp at 25° C.

13. The apparatus of claim 12, wherein the viscosity of the processing solution is 1.7 and 5 cp at 25° C.

14. The apparatus of claim 1, wherein a surface tension of the processing solutions is 15.0 and 50.0 dyne/cm.

15. The apparatus of claim 14, wherein the surface tension of the processing solutions is 18.0 and 45.0 dyne/cm.

* * * * *